United States Patent [19]

Bergman

[11] 4,240,566

[45] Dec. 23, 1980

[54] CAPTIVE MIXING CAP ARRANGEMENT FOR MULTIPLE CHAMBER CONTAINER

[75] Inventor: Carl P. Bergman, Pompano Beach, Fla.

[73] Assignee: Whirlco, Inc., Pompano Beach, Fla.

[21] Appl. No.: 76,143

[22] Filed: Sep. 17, 1979

[51] Int. Cl.[3] ..... B67D 5/42; B65D 25/44

[52] U.S. Cl. ..... 222/135; 222/485; 222/568; 206/219; 215/6

[58] Field of Search ..... 206/219; 215/6; 222/135, 136, 137, 485, 509, 521, 525, 390, 568, 94, 145, 562

[56] References Cited

U.S. PATENT DOCUMENTS

| | | | |
|---|---|---|---|
| 245,858 | 8/1881 | Newton . | |
| 1,357,024 | 10/1920 | Behrman . | |
| 2,055,582 | 9/1936 | Lewis et al. . | |
| 2,806,640 | 9/1957 | Wroblewski . | |
| 2,898,019 | 8/1959 | Williams | 222/568 X |
| 2,969,168 | 1/1961 | Newby . | |
| 3,201,013 | 8/1965 | Porter et al. | 222/525 |
| 3,221,952 | 12/1965 | DeSee . | |
| 3,236,457 | 2/1966 | Kennedy et al. . | |
| 3,269,389 | 8/1966 | Meurer et al. . | |
| 3,323,682 | 6/1967 | Creighton et al. | 222/137 X |
| 4,046,288 | 9/1977 | Bergman | 222/390 X |

FOREIGN PATENT DOCUMENTS

| | | | |
|---|---|---|---|
| 281613 | 1/1931 | Italy | 272/94 |

*Primary Examiner*—David A. Scherbel

*Attorney, Agent, or Firm*—Cushman, Darby & Cushman

[57] ABSTRACT

A container is provided with two chambers, each with a mechanism for expressing its contents toward an outlet neck. The neck mounts a captive cap with an opening through its end wall. A web which longitudinally divides the outlet neck, has an outer tip which is positioned to clean out and close the cap opening as a collar which encircles the captive cap is rotated to axially move the captive cap further onto the container. Rotation of the collar in the angularly opposite sense axially projects the cap so that container contents moving out the neck in the individual lumens can mix where the lumens merge and flow out together through the captive cap outer end opening.

6 Claims, 5 Drawing Figures

CAPTIVE MIXING CAP ARRANGEMENT FOR MULTIPLE CHAMBER CONTAINER

BACKGROUND OF THE INVENTION

The present inventor is the named patentee in U.S. Pat. 4,046,288, issued Sept. 6, 1977.

That patent shows a dispenser in which a plurality, e.g. two, fluid product-containing cylinders are joined, side-by-side in a body, with their dispenser spouts adjoining one another. An operator assembly is fitted on the opposite end of the body and unites a cap, an operator, such as a handwheel, a helically threaded rod for each cylinder, a piston mounted on each rod for longitudinal travel upon rotation of the rod, a gear plate receiving a set of gears which interconnect the threaded rods with the operator, so that as the operator is turned, the pistons are advanced.

In that patented dispenser, the outlet conduits from each reservoir run along inside a common neck and there is an axially short manifold region just back of the dispenser tip of the neck, in which the outlet conduits merge into one. The closure shown is a snap-on/removable cap.

The Bridgeport Chemical Corporation, an employer of the present inventor markets many adhesive and caulking products, to other manufacturers, to builders, hobbiests and to do-it-yourselfers. One of its affiliates markets various caulking products in a container that, to the casual observer, looks like what is shown in FIG. 1 of the drawings hereof, i.e. a container 10 that has a generally cylindrical body 12, with a dispenser spout arrangement 14 at one end and a rotatable actuator 16 at the opposite end. Unseen within the container 10 some plastic product is contained; in order to get that product out, the actuator 16 is rotated in a sense to advance a piston means that is unseen within the container and thus force product out of the tip 18 of the dispenser spout 14.

The existing caulk-dispenser is shown and described in my earlier U.S. Pat. No. 4,144,988, issued Mar. 20, 1979.

In short, what the present invention was developed to provide is a dispensing container for multiple component products which is an improvement upon what is shown in my aforementioned U.S. Pat. No. 4,046,288, particularly as to the captive cap and closure plug of the invention, and to provide a product which advantageously may have much the same appearance as the single component dispenser of my aforementioned U.S. Pat. No. 4,144,988.

The disclosures of both my aforesaid prior U.S. patents in their entireties are incorporated herein by reference.

SUMMARY OF THE INVENTION

A container is provided with two chambers, each with a mechanism for expressing its contents toward an outlet neck. The neck mounts a captive cap with an opening through its end wall. A web which longitudinally divides the outlet neck has an outer tip which is positioned to clean out and close the cap-opening as a collar which encircles the captive cap is rotated to axially move the captive cap further onto the container. Rotation of the collar in the angularly opposite sense axially projects the cap so that container contents moving out the neck in the individual lumens can mix where the lumens merge and flow out together through the captive cap outer end opening.

The present invention provides a container having a captive cap of the outlet-ported, axially movable type, an internal plug to stopper the outlet port of the cap when the cap is axially moved to one extreme; the container having wall means defining at least two internal reservoirs for contents, all on different sides of an internal longitudinal web means on an outer end of which said internal plug is mounted in juxtaposition with said outlet port.

The principles of the invention will be further discussed with reference to the drawings wherein a preferred embodiment is shown. The specifics illustrated in the drawings are intended to exemplify, rather than limit, aspects of the invention as defined in the claims.

Figure 1:
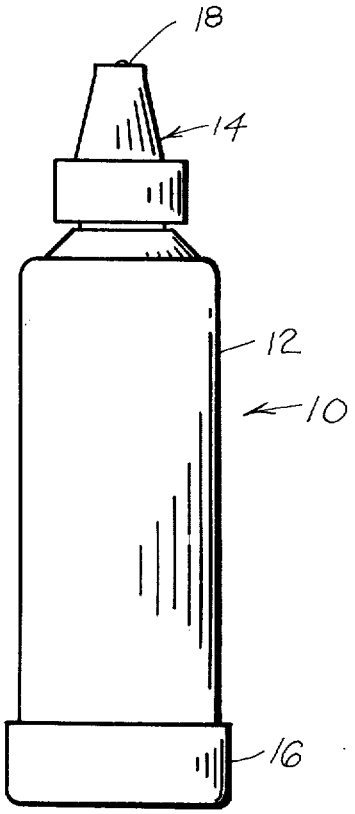
FIG. 1 is a small scale side elevation view of a dispenser provided with a cap in accordance with the present invention.
Figure 5:
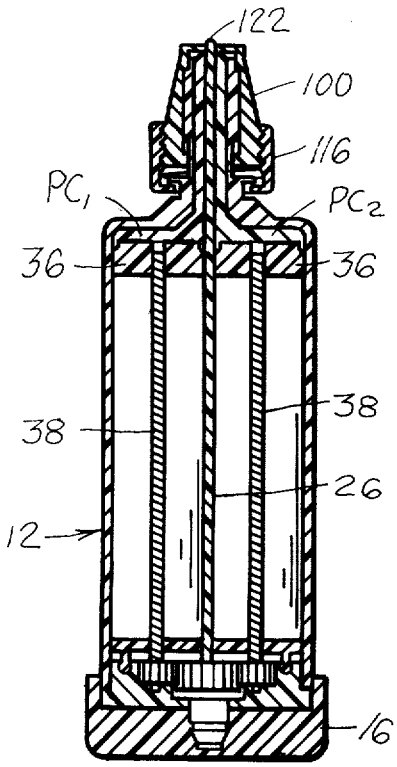
FIG. 5 is a view similar to FIG. 2, but on the same scale as FIG. 1, and at a later stage, at which time nearly all the contents have been dispensed.
Figure 2:
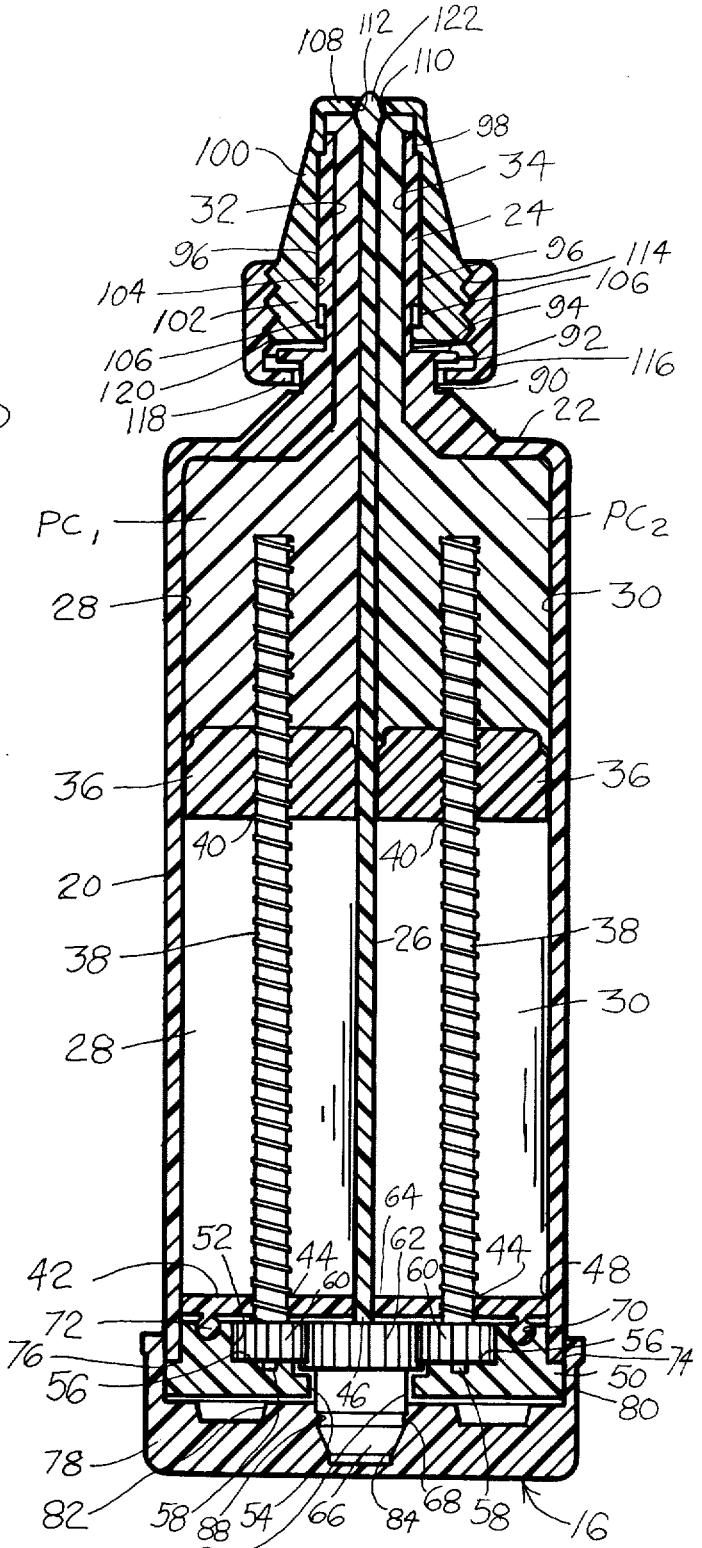
FIG. 2 is a larger-scale longitudinal sectional view thereof.
Figure 3:
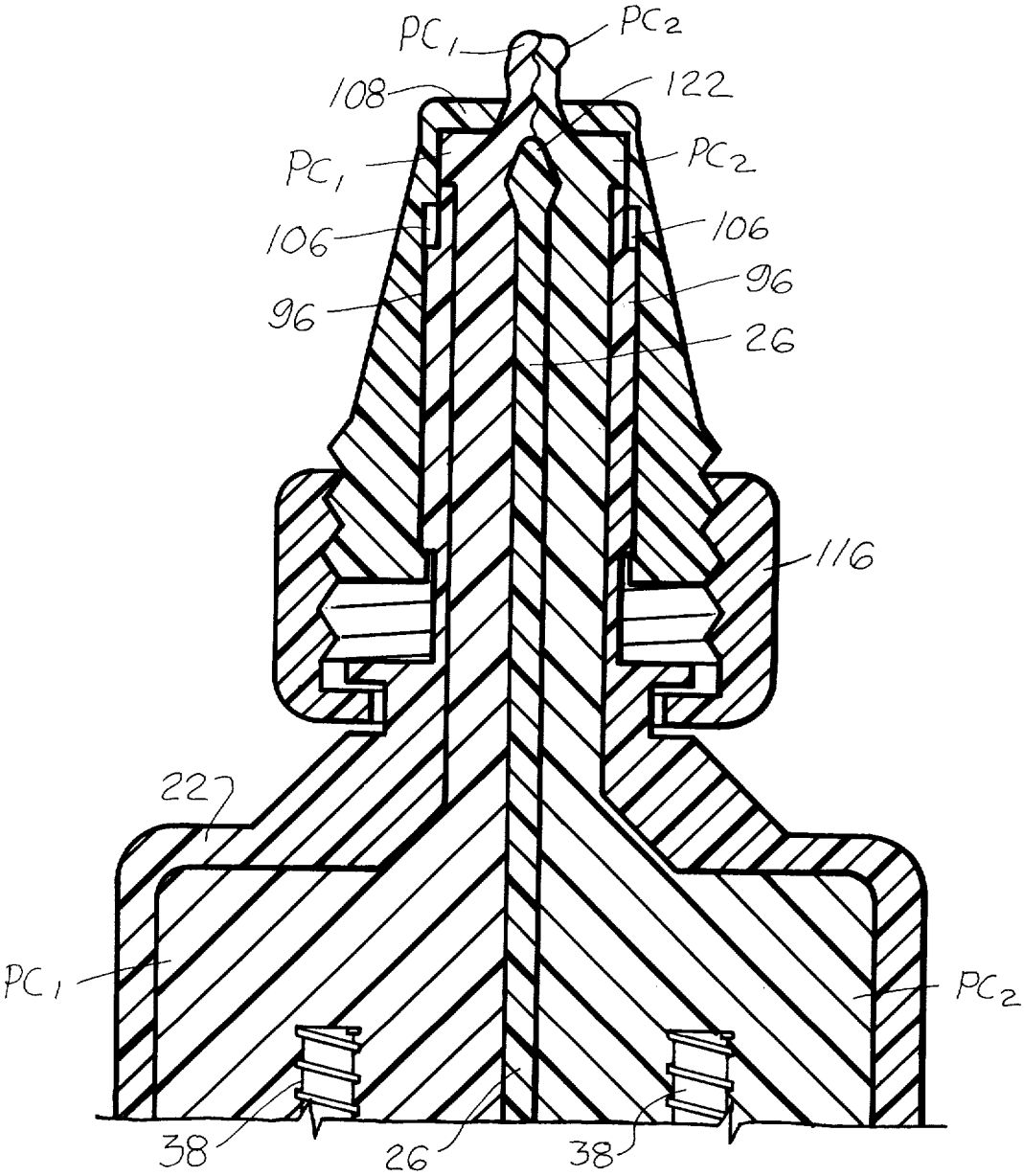
FIG. 3 is an even-larger-scale fragmentary longitudinal sectional view of the outlet end region thereof.

The cap is shown closed in FIGS. 1, 2 and 5, and open in FIG. 3.

DETAILED DESCRIPTION OF THE PRESENTLY PREFERRED EMBODIMENT

Referring to FIG. 1, the container 10 has a generally cylindrical body 12, with a dispenser spout arrangement 14 at one end and a rotatable actuator 16 at the opposite end. Unseen within the container 10 (in this Figure) a plastic product is contained. In order to get that product out, the actuator 16 is rotated in a sense to rotate a piston means (unseen in this Figure) and thus force the product out of the tip 18 of the dispenser spout 14.

As shown in FIG. 2, the container 10 may be molded and assembled of plastic parts, with the caution that the contained product must not be one which will dissolve or adversely react with the container material. The tubular side wall 20 is shown integrally formed with an annular forward end wall 22 from which a tubular dispenser spout 24 coaxially forwardly projects. The tubular side wall 20 also is integrally formed with a web 26 which extends longitudinally centrally within the internal space of the cylindrical body 12, which also extends longitudinally centrally within and is integrally formed with the tubular dispenser spout 24.

Figure 4:
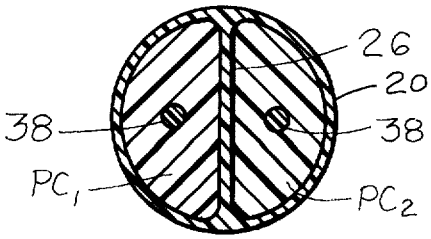
FIG. 4 is an intermediate level transverse cross-sectional view of the dispenser, drawn to the same scale as FIG. 1.

As shown (see FIG. 4), the web divides the internal space into two separate compartments 28, 30, having respectively separate channels or lumens 32, 34 out through the dispenser spout to the vicinity of the tip 14.

A typical arrangement for co-dispensing both components of a two component plastic product from the container 10 also is shown in FIG. 2. Here, the two product components are illustrated at $PC_1$ and $PC_2$ partly filling the respective chambers 28, 30. The quantums of product are backed by respective pistons 36 sealingly, slidably fitted in the respective chambers 28, 30 behind the respective quantums of product. Each piston 36 is of noncircular transverse cross-sectional figure, and has a respective drive screw 38 threadedly received therethrough via a correspondingly threaded central, axially extending opening 40. Accordingly, rotating both drive screws in respective first angular senses advances both pistons axially decreasing the volume in the cylindrical body ahead of the pistons and thus forcing the product components to be compressed and seek to escape through the tubular dispenser spout 24.

In the illustrated embodiment, the rear ends of the compartments 28, 30 are closed by a sealing disk 42 which has openings 44 out through which the drive screws 38 project. The disk 42 may be secured in place by any convenient means, e.g. by being force fit over a central projection 46 on the web 26 rear end and solvent welded about its periphery 48 to the internal surface of the side wall 20. A gear-mounting plate 50 is shown provided with a three-lobed compartment 52 in its inner face. The central pocket of the compartment 52 includes an opening 54 which extends outwardly through the plate 50 and the two flanking lobes which intersect with the central lobe each include sockets 56 which open forwardly to act as sleeve and thrust bearings for the unthreaded stubs 58 at the rear ends of the respective lead screws 38. Each lead screw 38 has a driven gear fixedly provided thereon near the respective stub end thereof. These are received in the respective flanking lobes of the compartment 52. The central lobe of the compartment 52 receives a driving gear 62 that is assembled in meshing, driving relation with both gears 60. The web central rear projection 46 has a tip portion (obscured in FIG. 2) which is received in a corresponding central detent (also obscured) in the forward face 64 of the driving gear which functions as a centering bearing therefor. The driving gear 62 has a stub shaft 66 which projects coaxially rearwardly and is shown provided with a radially outwardly opening circumferential detent groove 68.

The gear mounting plate 50 is shown provided in the forward face thereof near the outer periphery thereof with a plurality of undercut sockets 70 into which correspondingly located bulbous projections 72 on the rear face of the sealing disk 42 are snap fit to secure the plate 50 to the disk 42 with the gears 60, 62 housed therebetween as shown. Incursion of the plate 50 into the rear end of the internal space of the cylindrical body 12 is peripherally limited by abutment of an axially forwardly facing circumferential shoulder 74 with the rear end 76 of the tubular side wall 20.

The rotatable actuator 16 is shown constituted by a disk-shaped body 78 integrally formed with a coaxially forwardly projecting tubular skirt 80. The axially forward face of the body 78 is centrally provided with a boss 82 in which a forwardly opening socket 84 is coaxially formed. The socket side wall 86 is coaxially provided with a circumferentially extending, radially inwardly projecting bead 88. The rotatable actuator 16 is assembled to the container by pushing the stub 66 into the socket 84 until the bead 88 snaps into the groove 68. When so assembled to the container, the skirt 80 of the actuator 16 hides the abutment 74/76.

The actuator 16, if rotated angularly of the container causes the stub 66 and thus the driving gear 62 to rotate. As the driving gear 62 is rotated, the driven gears 60 and thus the drive screws 38 are rotated to advance the pistons. (Rotation of the actuator 16 in an angularly opposite sense can be performed when the user is finished with dispensing in order to take the pressure off the remaining contents of the container.)

By preference, the drive screws 38 do not extend all the way forwardly in the chambers 28 and 30, but terminate short of reaching the forward end wall 22 by an amount which is related to the structure of the piston. Referring to FIG. 5, one can see the container at a later stage than in FIG. 2, a stage at which the container's remaining contents are almost exhausted; the pistons are beginning to run off the forward ends of the drive screws. A couple of additional turns of the actuator 16 will advance the pistons only slightly further. Then the threads in the piston openings 40 will run off the threading of the drive screws 38 and any further turning of the actuator 16 will be to no effect. This provision is made in order to prevent continued turning of the actuator, once the container is substantially empty from destroying the integrity of the container by compression of the pistons 36 against the forward end wall 22.

Upon closer inspection, the tubular dispenser spout is seen to be externally provided (from nearest the wall 22) with a radially outwardly opening circumferential groove 90, a circumferential radially outwardly projection flange 92 having an axially forwardly presented shoulder 94, a pair of diametrically opposed radially projecting longitudinal ribs 96. The ribs are slightly shorter than the neck, so a brief cylindrical radially outwardly facing portion 98 is left adjacent the forward end of the container neck.

The captive cap 100 is a tubular body 102 with a longitudinal central throughbore 104. Intermediate its ends the bore 104 is provided with two diametrically opposed longitudinal grooves 106, which correspond to, but are somewhat longer than the ribs 96. When the captive cap 100 is snapped into place on the neck, the ribs 96 are received in the respective groove 106.

The captive cap 100 further preferably integrally, includes a disk-shaped forward end wall 108 that is centrally provided with a dispenser opening 110, preferably tapered in an undercut manner to provide a convergent internal circumferential surface 112.

Near the rear end thereof, the body 102 is externally threaded as at 114.

The dispenser spout arrangement 14 further includes an internally threaded annular collar 116 having a coaxially annular radially inwardly projecting rear end flange 118. When the collar 116 is fully threaded onto the body threading 102 at 120, the flange 118 snaps past the flange 92.

Thus, if the collar 116 is rotated in one angular sense, the cap 100 will be pulled down tighter toward the body 12, and the bulbous enlargement 122 centrally provided on the forward end of the web will be sealingly jammed into the dispenser opening 110 as shown in FIGS. 2 and 5, closing the opening and pushing out any mixed components $PC_1/PC_2$ found therein. If the collar 116 is rotated in the opposite angular sense, the cap 100 will be projected forwards opening up a gap in and back of the opening 110, between the end wall 108 and the bulbous boss 122, so that contents $PC_1/PC_2$ may be jointly dispensed in a joint stream as shown in FIG. 3, by turning the rotatable actuator 16. The amount by which the key ribs 96 are shorter than the keyway grooves 106 defines, by alternative abutment of the key ends with the keyway ends the two extremes of axial travel of the captive cap. Note that whereas the collar 116 is constrained to move essentially angularly, the captive cap 100 is constrained to move essentially axially, without angular rotation.

Although the device 10 was developed primarily to dispense a stream of an at least partially mixed two-component adhesive such as epoxy resin, that other (even substantially different) two-component products could be dispensed in the same way, e.g. to produce a marbled stripe of ketchup and mustard on a hot dog or to make a joined, bicolor line of icing or frosting upon a decorated cake. Whether equal amounts of $PC_1$ and $PC_2$ will be dispensed upon turning the actuator 16 is a manufacturing choise, determined, e.g. by the relative cross-sectional areas of the chambers 28 and 30, whether the gears 60 are of equal ratio with the gear 62 and whether the drive screws 38 have the same pitch of thread. Accordingly, it is as easy to make a device 10 which dispenses, at least partially mixed or joined in a single line equal amounts of two components, or any desired ratio of one component to the other.

Although it is presently preferred to use the captive cap arrangement of the invention on a dispenser tube having a twistable actuator 16, with internal piston-assisted discharge, the same captive cap arrangement could be used to advantage on other types of containers, e.g. for two squeeze-and-roll-up-type toothpaste tubes screwed into a fitting (not shown) that would look a lot like the FIG. 3 fragmentary view, except that it would be internally threaded at 124 to receive the two toothpaste tube necks, instead of having drive screws 38.

Although the device 10 has been shown having a generally bisecting-planar web 26, it is clear that without departing from the principles of the invention, the web 26 could be made to have Y-shape in order to provide the cylindrical body and spout with three (instead of only two) separated internal compartments communicated to the outlet opening, or to have an X-shape in order to provide four separated internal compartments communicated to the outlet opening.

It should now be apparent that the captive mixing cap arrangement for multiple chamber container as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications are are within the spirit and scope of the following claims.

What is claimed is:

1. A container, having:

wall means including a neck portion;

a captive cap of the axially movable type, said cap having opening means defining an outlet port;

an internal plug to stopper the outlet port of the cap when the cap is axially moved to one extreme;

said container wall means further including an internal web means, said wall means defining at least two internal reservoirs for contents, all on different sides of said internal longitudinal web means, said internal longitudinal web means having an outer end, said internal plug being mounted on said outer end in juxtaposition with said outlet port in said neck portion of said wall means.

2. The container of claim 1, wherein:

the internal plug is of forwardly taperingly bulbous form and the outlet port is forwardly convergent so that the plug may be jam fit in the outlet port to sealingly close the outlet port.

3. The container of claim 1, further including:

interdigitating longitudinal key and axially somewhat longer keyway means on and between said captive cap and said container neck portion for constraining said captive cap to essentially axial, non-rotative movement between a first condition wherein the outlet port is closed by the plug and a second condition wherein the outlet port is moved axially away from the plug and is open so that contents may be jointly dispensed from all of said at least two reservoirs.

4. The container of claim 3, further including:

an external collar threaded on said captive cap and constrained against substantial axial movement on said neck, so that rotation of said collar in two angularly opposite senses moves said captive cap between said two conditions thereof.

5. The container of claim 3, further including:

a respective piston slidingly received in each said internal reservoir; and means for advancing each piston in each internal reservoir in a sense to compress the contents thereof toward said neck.

6. The container of claim 1, wherein:

said web bisects said container into two internal reservoirs.

* * * * *